US006837144B2

(12) United States Patent
Herwig

(10) Patent No.: US 6,837,144 B2
(45) Date of Patent: Jan. 4, 2005

(54) PISTON AND CYLINDER UNIT INCLUDING A HOUSING, A PISTON AND A PISTON ROD

(75) Inventor: Karl-Wilhelm Herwig, Bad Sooden-Allendorf (DE)

(73) Assignee: Hyco Pacoma GmbH, Eschwege (DE)

( * ) Notice: Subject to any disclaimer, the term of this patent is extended or adjusted under 35 U.S.C. 154(b) by 72 days.

(21) Appl. No.: 10/294,852

(22) Filed: Nov. 14, 2002

(65) Prior Publication Data

US 2003/0094097 A1 May 22, 2003

(30) Foreign Application Priority Data

Nov. 16, 2001 (DE) ..... 101 56 504

(51) Int. Cl.[7] ..... F15B 15/20
(52) U.S. Cl. ..... 92/128; 92/255
(58) Field of Search ..... 92/128, 165 PR, 92/255, 258

(56) References Cited

U.S. PATENT DOCUMENTS

| | | | | | |
|---|---|---|---|---|---|
| 2,683,422 | A | * | 7/1954 | Richards, Jr. | 91/493 |
| 2,987,046 | A | | 6/1961 | Atherton | 121/80 |
| 3,238,559 | A | * | 3/1966 | Muller | 452/43 |
| 3,293,993 | A | | 12/1966 | Wilmette, III | 91/396 |
| 3,474,710 | A | * | 10/1969 | Stryker | 92/128 |
| 3,650,182 | A | * | 3/1972 | Phillips | 92/128 |
| 3,885,461 | A | * | 5/1975 | Crisp et al. | 92/255 |
| 5,564,327 | A | * | 10/1996 | Sims | 92/255 |
| 5,904,440 | A | * | 5/1999 | Sims | 92/128 |

FOREIGN PATENT DOCUMENTS

| | | | | |
|---|---|---|---|---|
| DE | 2937412 A | | 4/1981 | F16J/1/12 |
| FR | 2420677 A | | 10/1979 | F15B/15/20 |
| FR | 2755739 A | | 5/1998 | F15J/15/06 |
| JP | 57061837 A | * | 4/1982 | F16F/9/06 |

* cited by examiner

*Primary Examiner*—Thomas E. Lazo
(74) *Attorney, Agent, or Firm*—Thomas, Kayden, Horstemeyer & Risley, LLP

(57) ABSTRACT

A piston and cylinder unit includes a housing, a piston and a piston rod. The piston rod has an outer surface being designed to be symmetrical with respect to a first axis. The piston rod includes a protrusion and an outer thread being located on the protrusion. The protrusion and the outer thread are designed to be symmetrical to a second axis. The second axis is spaced apart from the first axis to define a first eccentricity of the piston rod. The piston is located in the housing. The piston has an outer surface being designed to be symmetrical with respect to a first axis. The piston includes at least one seal, at least one guiding element, an opening and an inner thread being located in the opening. The opening and the inner thread are designed to be symmetrical to a second axis. The second axis is spaced apart from the first axis to define a second eccentricity of the piston. The first eccentricity of the piston rod is substantially identical to the second eccentricity of the piston such that the inner thread of the piston can engage the outer thread of the piston rod to reach an angle position in which the first axis of the piston rod is aligned to the first axis of the piston.

15 Claims, 1 Drawing Sheet

PISTON AND CYLINDER UNIT INCLUDING A HOUSING, A PISTON AND A PISTON ROD

CROSS REFERENCE TO RELATED APPLICATIONS

This application claims priority to co-pending German Patent Application No. 101 56 504.6 entitled "Kolben/Zylinder-Einheit mit einem Zylindergehäuse, einem Kolben und einer Kolbenstange", filed Nov. 16, 2001.

FIELD OF THE INVENTION

The present invention generally relates to a piston and cylinder unit including a housing, a piston having an axis and a piston rod having an axis. The piston includes a seal and at least one guiding element. The piston includes an opening including an inner thread being connected to an outer thread which is located on a protrusion of the piston rod. Usually, there is a guiding bush in which the piston rod of the piston and cylinder unit is guided and supported. The piston rod may end in a bearing lug with which it is arranged in a way not to be rotated, but only to reciprocate. The housing also includes a bearing, for example a bearing lug. The piston with its end being arranged in the housing in a movable way is connected to the piston rod.

BACKGROUND OF THE INVENTION

When the seals and/or the guiding elements of the piston have to be replaced, it is necessary to detach the guiding bush with respect to the housing, and to pull the piston rod with the piston being connected thereto out off the housing. When guiding elements, seals and/or stripping elements being associated with the piston rod and usually being located in the guiding bush have to be replaced, it is necessary to detach the piston from the piston rod to be capable of accessing the inner opening being located in the guiding bush.

The detachable arrangement and connection of the piston at the piston rod is an important issue for piston and cylinder units. The detachable connection has to be chosen such that the piston can withstand the axial forces produced by the fluid acting upon the piston, and such that it can transmit these forces onto the piston rod.

Furthermore, is it necessary to seal the fluid in a region between the piston and the piston rod. In the case of a threaded connection existing between the piston and the piston rod, it is necessary to prevent unintentional loosening of the connection under operational loads by the piston rotating with respect to the piston rod.

In the art, one differentiates between so called "pre-tensioned connections" and "not-pre-tensioned" connections. In the case of pre-tensioned connections, a tightening moment or torque is applied by the threaded connection such that the piston and the piston rod in the mounted position are pressed against one another in a pre-tensioned way. Usually, it is necessary to harden the front surfaces of the piston and of the piston rod to fulfill the requirements of the acceptable surface pressure, and to realize the required great tightening moments. Such a great tightening moment has substantial advantages during operation of the piston and cylinder unit since the piston is only subjected to a pulsating stress, and the axial force resulting from the tightening moment always remains more than the axial force caused by the fluid. The tightening moment is the first way of securing the piston against unintentional detachment under operational conditions.

It is also known to use a second way of securing the piston. When replacing the seal and/or the guiding element being associated with the piston rod, unintentional loosening of a piston being mounted to a piston rod with a tightening moment is a substantial problem. This is especially true when one realizes that it is often the case that such piston and cylinder units are part of construction machines, excavators and the like which are usually repaired outside and without factory equipment.

Another piston and cylinder generally known in the art includes a piston being pushed upon a protrusion of the piston rod. The opening of the piston is designed to be continuous in an axial direction, but it does not include a thread. The protrusion of the piston rod includes an outer thread on which a locking nut is arranged by screwing after having pushed the piston onto the protrusion. The locking nut has an opening and an associated inner thread. For example, the locking nut may include a plastic material. The plastic material serves as a securing element against unintentional loosening. In this way, a non-positive securing effect against rotation is used.

It is also generally known in the art to combine the piston and the locking nut to attain one common element such that the associated inner thread is located in an opening of the piston. As the securing element, a pin screw being located in the piston in a radial direction is used, the pin screw in the mounted position pressing upon the protrusion of the piston rod. The piston has to include a respective engagement surface for a tool to be capable of applying the necessary great tightening moment during assembly and the respective loosening moment during detachment it is often necessary to use special tools.

Both known ways of connecting the piston by using the effect of a great tightening moment show drawbacks as it will be described in the following. The great moments necessary during assembly and detachment can only be applied by special tools. The piston or an additional securing element has to include respective engagement surfaces for the special tool. Additional components for realizing an additional element securing against unintentional rotation are necessary, and they result in the structural length in the region of the piston being increased. The front surfaces of the piston and of the piston rod substantially extend in a radial direction, and they contact one another. The front surfaces have to be hardened in a rather complicated way.

Such known piston rod connections are complicated concerning manufacture, and they are rather difficult concerning repairing and servicing. To be capable of arranging the required static seal between the piston and the piston rod, the piston and the piston rod are designed such that they overlap in an axial direction to an extent necessary for arranging the static seal. In this way, the surface of the piston rod which has been produced which great care is also used as a counter surface for the static seal. However, the axial length of the piston is increased in a disadvantageous way, and the piston rod is respectively shortened. This has to be compensated in another way.

Another piston and cylinder unit is known from U.S. Pat. No. 3,293,993. The known piston and cylinder unit includes a housing, a piston having an axis and a piston rod having an axis. A static seal is located between the piston and the piston rod. The piston includes a plurality of piston seals also serving as guiding elements, or which may be replaced by guiding elements by a person with skill in the art. The piston with an inner thread being located in an opening is connected to a protrusion of an outer thread being located on the piston rod. The axes of the threads and the axes of the piston and the piston rod coincide. The known piston and cylinder unit does not include a unit for preventing rotation of the piston with respect to the piston rod, and U.S. Pat. No. 3,293,993 is not related to a design being safe and easy to be repaired.

Another piston and cylinder unit serving to simplify repairing of the arrangement of the piston is also known in the art. The piston and the piston rod are connected by screwing an outer thread loosely into an inner thread. It is also necessary to arrange a static seal being effective in the region of the surface of the piston rod. The known piston and cylinder unit includes a unit for preventing rotation of the piston with respect to the piston rod. The connection of the piston and the piston rod is realized without applying a tightening moment. A bolt, a bush and the like is used as the unit for preventing rotation, the bolt, the bush and the like protruding into an axial bore being arranged such that it protrudes through the threaded portion between the piston rod and the piston. The bush, the bolt and the like also has to be secured against axial movement. Usually, this is achieved by a screw including a securing disc and protruding through the piston in an axial direction. The screw including the securing disc forms a stop against movement of the bush, the bolt and the like. Such an arrangement of the piston requires use of a comparatively great number of additional components serving to prevent rotation. Due to the design and arrangement of the elements, one attains a comparatively long structural length in the region of the connection between the piston and the piston rod. The known arrangement and attachment of the piston is rather complicated and expensive taking the production of the required separate elements into account.

SUMMARY OF THE INVENTION

The present invention relates to a piston and cylinder unit including a housing, a piston and a piston rod. The piston rod has an outer surface being designed to be symmetrical with respect to a first axis. The piston rod includes a protrusion and an outer thread being located on the protrusion. The protrusion and the outer thread are designed to be symmetrical to a second axis. The second axis is spaced apart from the first axis to define a first eccentricity of the piston rod. The piston is located in the housing. The piston has an outer surface being designed to be symmetrical with respect to a first axis. The piston includes at least one seal, at least one guiding element, an opening and an inner thread being located in the opening. The opening and the inner thread are designed to be symmetrical to a second axis. The second axis is spaced apart from the first axis to define a second eccentricity of the piston. The first eccentricity of the piston rod is substantially identical to the second eccentricity of the piston such that the inner thread of the piston can engage the outer thread of the piston rod to reach an angle position in which the first axis of the piston rod is aligned to the first axis of the piston.

The present invention also relates to a piston assembly including a piston and a piston rod being connected to the piston. The piston rod has an outer surface being designed to be symmetrical with respect to a first axis. The piston rod includes an outer thread being designed to be symmetrical with respect to a second axis. The second axis is spaced apart from the first axis to define a first eccentricity of the piston rod. The piston has an outer surface being designed to be symmetrical with respect to a first axis. The piston includes an opening and an inner thread being located in the opening. The opening and the inner thread are designed to be symmetrical with respect to a second axis. The second axis is spaced apart from the first axis to define a second eccentricity of the piston. The first eccentricity of the piston rod is substantially identical to the second eccentricity of the piston such that the inner thread of the piston can engage the outer thread of the piston rod to reach an angle position in which the first axis of the piston rod is aligned to the first axis of the piston.

The novel piston and cylinder unit may be mounted without having to apply a substantial tightening moment. The required element for preventing rotation of the piston being connected to the piston rod is realized with a comparatively low number of components and at comparatively low costs.

The novel piston and cylinder unit includes a piston having an inner thread not being arranged in a centric and symmetric way with respect to the outer surface of the piston, but instead spaced apart from the usual center axis and eccentric to the outer surface of the piston. Thus, the opening of the piston and the inner thread being located in the opening define an eccentric axis being arranged to be parallel and at a distance with respect to the center axis of the entire piston. This distance is herein called eccentricity. The same applies to the design of the piston rod, to the protrusion being located at the end of the piston rod and facing the piston and to the outer thread being located thereon. The piston rod with its outer circumference of its portion facing the piston has a first axis, while the protrusion and the outer thread define and have an eccentric axis being arranged to be parallel and spaced apart from the axis of the entire piston rod. The eccentricity used in the region of the piston is substantially identical to the eccentricity used in the region of the piston rod. Substantially identical means that it is desired to realize exactly the same eccentricity, but the actual value of the eccentricity depends on the tolerances with which the components are manufactured.

With the novel construction of the piston and cylinder unit, the piston may be connected to the piston rod by simply screwing it onto the outer thread of the piston rod. For this purpose, only comparatively low forces have to be applied. During assembly, the piston itself fulfills an eccentric rotational movement with respect to the axis of the piston rod. During each full rotation of the piston with respect to the piston rod, there only is one angle position in which the axis of the piston rod is aligned to the axis of the piston. One of these angle positions (each occurring during one full rotation of the piston) may be called the "angle end position" or "final angle position" in which the axis of the piston rod is aligned to the axis of the piston. This means that the piston is being connected to the piston rod by a rotational movement until the desired final angle position has been reached. The circumferential surfaces of the piston and the piston rod are aligned with their axes, and it is possible to introduce the unit including the piston rod, the piston and the guiding bush into the housing to mount it at this place. The above described eccentricity, the required piston seal and the restoring forces being applied by the guiding elements of the piston are used to prevent unintentional rotational movement from occurring between the piston and the piston rod during use of the piston and cylinder unit. These restoring forces are sufficient to prevent clamping of the piston in its cylindrical path of movement of the cylinder housing.

The novel way of preventing rotational movement realized by the eccentricity does not require the use of additional securing elements. The novel piston assembly includes a comparatively low number of components, and it may be produced at low costs. It is not even necessary to arrange engagement surfaces for a tool for contacting the piston since the piston may be rotated for assembly and detachment simply by screwing by hand. Substantial tightening moments are not used such that it is also not necessary to harden the front surfaces of the piston and of the piston rod. The novel piston assembly preferably has a short structural length, and it also has the effect that the full length of the piston rod may be used.

It is especially preferred if the piston rod in the region of its protrusion includes a stud element and the piston in the region of its opening includes a respective bore, the stud element and the opening being designed to define substantially the same eccentricity as the piston rod and the piston. A static seal may be arranged in this region. The static seal is not located in the region of the surface of the piston rod, but rather in the region of the protrusion. However, this is not disadvantageous since the piston and the piston rod have to have a respective axial length usually being more than the axial length of the inner thread and the outer thread due to the arrangement of the piston seal and usually a plurality of guiding elements, such as guiding rings, guiding bands and the like.

However, there also is another possibility of arranging the static seal. For example, the inner thread of the piston may be designed to be continuous in an axial direction, and the piston rod may include an outer thread extending along the axial length of the protrusion. The static seal is then located between the inner thread and the outer thread. The seal may also provide a force at this place, the force counteracting unintentional loosening of the piston with respect to the piston rod during use of the novel piston and cylinder unit.

Preferably, the common eccentricity is in a range of approximately 0.5 to 5.0 percent of the outer diameter of the piston rod. The value of the common eccentricity—meaning the value of the substantially identical first and second eccentricities—usually depends on the absolute value of the diameter of the piston rod. It should not be chosen to be too great to keep the bending stress acting upon the piston rod and being caused by the eccentricity as low as possible. On the other hand, the common eccentricity preferably is chosen to be great enough such that the restoring forces of the seal and of the guiding element of the piston are sufficient to prevent a relative rotational movement of the piston with respect to the piston rod during use of the unit. It has been found that an eccentricity in a range of approximately 1–2 mm is especially advantageous when the outer piston diameter is approximately 80 mm. If the eccentricity is chosen to be too great, the usable diameter for the inner thread and the outer thread is decreased. It is preferred when the diameter of the inner thread of the piston and the diameter of the outer thread of the piston rod have been chosen to be rather great to transmit a great axial force. All known kinds of threads may be used for realizing the inner thread of the piston and the outer thread of the piston rod, especially fine threads and such threads having a great bearing percentage in an axial direction. The inclination of the thread or the thread pitch preferably is chosen not to be too great to be capable of reaching the final angle position within a comparatively short path of movement, and to be capable of handling the necessary tolerances during the stroke of the piston in the cylinder. The inner thread and the associated outer thread may especially have a thread pitch of approximately between 2 mm and 5 mm.

It is especially preferred when the piston rod is designed and arranged to protrude out of the piston in a rear direction (meaning all the way through the piston) in the angle position in which the first axis of the piston rod is aligned to the first axis of the piston. The piston rod is designed and arranged to directly contact the housing in a pressureless condition. In this way, the piston in its pressureless condition is also fee from forces. The forces being applied by a tool to be actuated by the piston and cylinder unit are accepted by the piston rod, and they are directly introduced into the housing.

Furthermore, it is especially preferred if the piston rod and the piston include marks being designed and arranged to indicate and determine the angle position in which the first axis of the piston rod is aligned to the first axis of the piston. Such marks may be applied on the piston rod and on the piston by small impressions, color dots, or in any other suitable way. The marks preferably are applied such that they last for a long time to also clearly indicate the fact of the final angle position being reached even in the case of repairing the unit and during reassembly of the unit after repairing. Such marks make sure that the final angle position is reached such that the unit including the piston and the piston rod may be introduced into the cylinder housing, and the guiding bush may be connected in a respective way.

In all cases, the piston rod may be attached without having to apply a substantial tightening moment. In this way, it is easier to repair the novel unit without any disadvantages occurring. The securing effect resulting from the eccentricity is sufficient. It is not necessary to use a second securing element.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
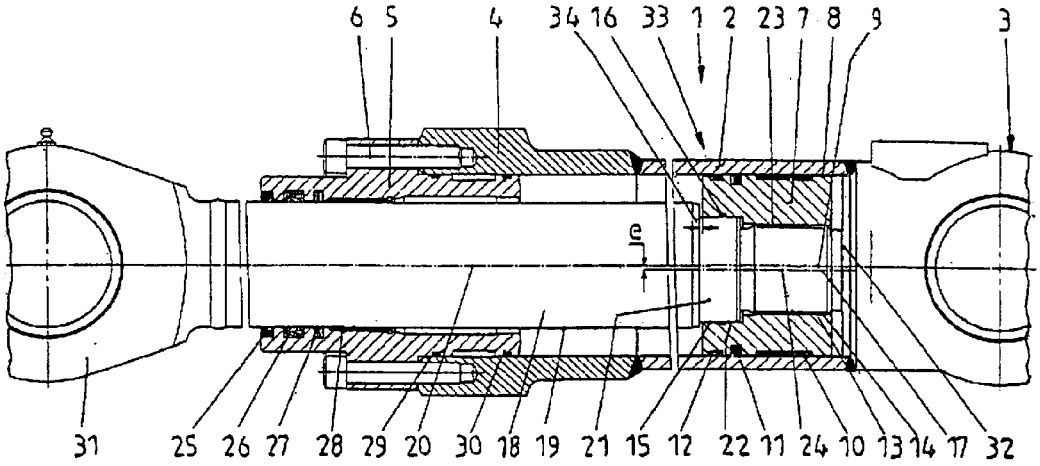
FIG. 1 illustrates a sectional view of a first exemplary embodiment of the novel piston and cylinder unit.

Referring now in greater detail to the drawings, FIG. 1 illustrates a novel piston and cylinder unit 1 including a cylinder and a cylinder housing 2 having a tube-like design. The cylinder housing 2 and at its one end is connected to a bearing 3. A connection bush 4 is connected to the other end of the housing 2 by welding, the connection bush 4 being designed and arranged to support a guiding bush 5. The guiding bush 5 is connected to the connecting bush 4 by screws 6.

A piston 7 is arranged in the housing 2 in a way to be movable in a sliding and sealing way. The piston 7 has an outer circumferential surface 8 having a usual cylindrical design. The piston 7 includes an axis 9 being located to be concentric with respect to the circumferential surface 8. Guiding and sealing elements are arranged on the outer circumferential surface 8 of the piston 7. In this case, there is a guiding band 10, a seal 11 and a guiding ring 12. The piston 7 further includes an opening 13 in this case having a step-like design. A part of the opening 13 includes an inner thread 14, while another part of the opening 13 is designed as a simple cylindrical bore 15. A static seal 16 is located in the region of the cylindrical bore 15. The opening 13 with its inner thread 14 and the bore 15 with its seal 16 are arranged to be eccentric with respect to the axis 9 of the piston 7. In this way, they have an eccentric axis 17 being arranged to be parallel with respect to the axis 9 of the piston 7. The distance between the axis 9 and the eccentric axis 17 is designated as the eccentricity "e".

The piston and cylinder unit 1 includes a piston rod 18 having an outer diameter 19 defining the outer circumference of the piston rod 18. The piston rod 18 has an axis 20 being located to be concentric with respect to its outer circumference. The axis 9 of the piston 7 is aligned with the axis 20 of the piston rod 18 in the mounted position.

The piston rod 18 at its end facing the piston 7 includes a protrusion 21. The protrusion 21 also has a step-like design in a way being coordinated with the design of the opening 13. A part of the protrusion 21 has a cylindrical circumferential surface 22. Another part of the protrusion 21 includes an outer thread 23. The protrusion 21 with its circumferential surface 22 and its outer thread 23 is arranged to be eccentric with respect to the axis 20 of the piston rod 18. The protrusion 21 includes an eccentric axis 24. The eccentric axis 24 extends in a direction parallel to and spaced apart from the axis 20 of the piston rod 18. This distance is designated as the eccentricity "e". The eccentricity "e" of the piston 7 and the eccentricity "e" of the piston rod 18 have the same value.

The piston rod 18 is arranged in the guiding bush 5 in a sliding and sealing way. For this purpose, a stripping element 25, a seal 26, a ring 27 and a guiding bent 28 are arranged in the guiding bush 5. The guiding bush 5 includes static seals 29 and 30 being located in a portion of the guiding bush 5 protruding into the connecting bush 4. The piston rod 18 at its end facing away from the piston 7 further includes a bearing 31 allowing for connection to a tool and the like. In the portion being located in the piston 7, the protrusion 21 includes a stop element 32. In the initial position, the stop element 32 contacts a front surface of the housing 2. A force acting upon the piston rod 18 is directly introduced into the housing 2 and its bearing 3, respectively, the piston 7 being bypassed. In the illustrated exemplary embodiment, the piston and cylinder unit 1 is designed to be double-acting. This means that pressure chambers being arranged at both sides of the piston 7 may be filled and subjected with a fluid, especially with a hydraulic fluid. Subjection is realized by a respective control valve in a way known in the art. However, the novel piston and cylinder unit 1 may also be designed to be single-acting.

For assembly of the novel piston and cylinder unit 1, the stripping elements 25, the seal 26, the ring 27 and the guiding bent 28 as well as the static seals 29 and 30 are mounted at the guiding bush 5. In the following, the piston rod 18 is pushed there through, and the piston 7 is connected by screwing after having inserted the static seal 16. Screwing of the piston 7 may be realized by hand since only respective frictional forces have to be overcome. During this screwing movement, the piston 7 rotates about the eccentric axis 24, the axis 9 moving on a circular path about the eccentric axis 24 at the protrusion 21 of the piston rod 18. During each full rotational movement about 360°, there exists one relative position between the piston 7 and the piston rod 18 in which the axis 9 of the piston 7 is aligned with the axis 20 of the piston rod 18. The screwing and rotational movement of the piston 7 is stopped at such an angle position 33 in which the axis 9 of the piston 7 is aligned with the axis 20 of the piston rod 18. In this way, the circumferential surface 8 of the piston 7 is also aligned with the axis 20 of the piston rod 18 and with the surface of the cylinder housing 2. Usually, there is a certain clearance 34 and a distance between the front connecting region between the piston rod 18 and the protrusion 21, on the one hand, and the respective front surface of the piston 7, on the other hand, respectively, since this results from manufacture of the inner thread 14 and the outer thread 23. In this angle end position 33, the unit including the piston rod 18, the guiding bush 5 and the piston 7 is introduced into the housing 2 of the cylinder, and they are fixed by the screws 6. In this position, the piston 7 cannot move with respect to the piston rod 18. The piston rod 18 with its bearing 31 is arranged in a way to prevent rotational movements. Pre-tensional forces and restoring forces of the guiding elements and the sealing elements 10, 11, 12 and friction in the region of the static seal 16 are sufficient to secure the angle end position 33 such that no relative rotational movement may occur between the piston 7 and the piston rod 18 during operation of the novel piston and cylinder unit 1.

Figure 2:
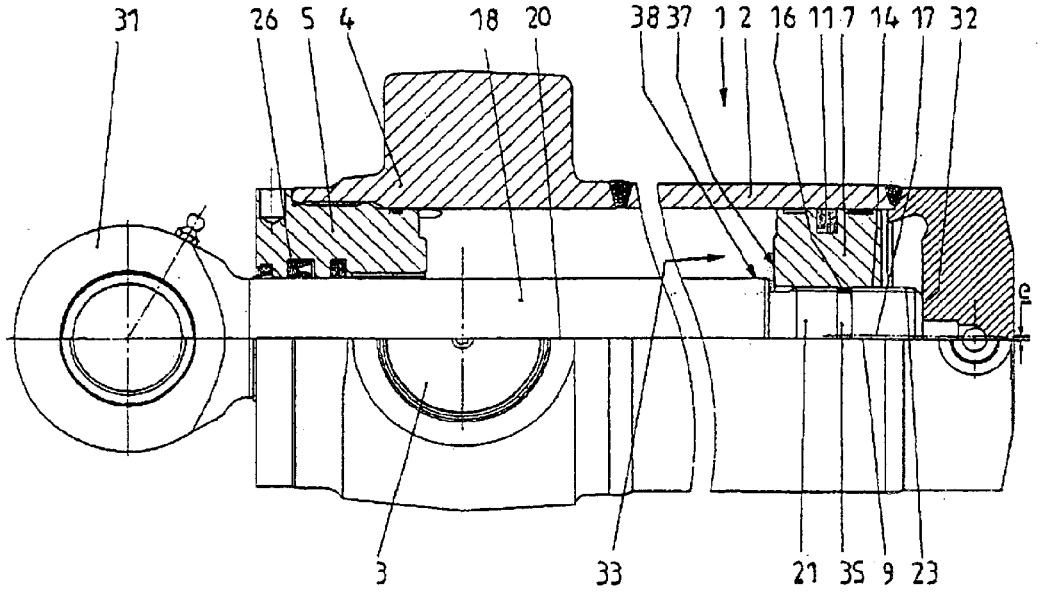
FIG. 2 is a sectional view of a second exemplary embodiment of the novel piston and cylinder unit.

The exemplary embodiment of the novel piston and cylinder unit 1 as illustrated in FIG. 2 uses a substantially similar way of fixing the piston 7 at the piston rod 18, as this has already been described with respect to the embodiment illustrated in FIG. 1. Again, the piston 7 and the piston rod 18 include a common eccentricity "e" from which a covering angle position between the axis 5 of the piston 7 and the axis 20 of the piston rod 18 result during each full rotational movement when screwing the piston 7 on the protrusion 21 of the piston rod 18. The static seal 16 being located between the piston 7 and the piston rod 18 is located in the region of an inner thread 14 being located at the piston 7 in a continuous way. The static seal 16 is located in a channel 35 being located at the protrusion 21. The outer thread 23 extends along a substantial portion of the length of the protrusion 21. In the mounted final angle position 33, there is a clearance 34 and a distance, respectively, between the associated front surfaces of the piston 7 and the piston rod 18.

In all exemplary embodiments of the novel piston and cylinder unit 1, it is especially advantageous when the piston 7 and the piston rod 18 both include marks 37, 38 from which the final angle position 33 may be seen. The marks 37, 38 may be designed as small impressions, color dots and the like. Especially in the case of repairing the novel piston and cylinder unit 1, they serve to simplify reaching and checking the final angle position 33 of the piston 7 being screwed on the piston rod 18.

Many variations and modifications may be made to the preferred embodiments of the invention without departing substantially from the spirit and principles of the invention. All such modifications and variations are intended to be included herein within the scope of the present invention, as defined by the following claims.

I claim:

1. A piston and cylinder unit, comprising:

a housing having a pressure chamber configured for fluid retention;

a piston rod having an outer surface being designed to be symmetrical with respect to a first axis, said piston rod including a protrusion and an outer thread being located on said protrusion, said protrusion and said outer thread being designed to be symmetrical with respect to a second axis, said second axis being spaced apart from said first axis to define a first eccentricity of said piston rod; and a piston being located in said housing said piston configured to be subjected to pressure of fluid in the pressure chamber, said piston having an outer surface being designed to be symmetrical with respect to a first axis, said piston including at least one seal, at least one guiding element, an opening and an inner thread being located in said opening, said opening and said inner thread being designed to be symmetrical with respect to a second axis, said second axis being spaced apart from said first axis to define a second eccentricity of said piston, the first eccentricity of said piston rod being substantially identical to the second eccentricity of said piston such that said inner thread of said piston can engage said outer thread of said piston rod to reach an angle position in which the first axis of said piston rod is aligned to the first axis of said piston.

2. The unit of claim 1, wherein said piston rod in the region of its protrusion includes a stud element and said piston in the region of its opening includes a respective bore, said stud element and said opening being designed to define substantially the same eccentricity as said piston rod and said piston, further comprising a static seal being arranged in this region.

3. The unit of claim 2, wherein said piston rod has an outer diameter being defined by said outer surface, the eccentricity of said piston rod and said piston being approximately 0.5 to 5.0 percent of the outer diameter of said piston rod.

4. The unit of claim 2, wherein the eccentricity of said piston rod and said piston is designed such that restoring forces of said seal and of said guiding element of said piston are sufficient to prevent rotational movement of said piston with respect to said piston rod during operation of said unit.

5. The unit of claim 1, wherein said inner thread of said piston is designed to be continuous in an axial direction, and said outer thread of said piston rod is designed to extend along the axial length of said protrusion, a static seal being located between said inner thread and said outer thread.

6. The unit of claim 5, wherein said piston rod has an outer diameter being defined by said outer surface, the eccentricity of said piston rod and said piston being approximately 0.5 to 5.0 percent of the outer diameter of said piston rod.

7. The unit of claim 5, wherein the eccentricity of said piston rod and said piston is designed such that restoring forces of said seal and of said guiding element of said piston are sufficient to prevent rotational movement of said piston with respect to said piston rod during operation of said unit.

8. The unit of claim 1, wherein said piston rod has an outer diameter being defined by said outer surface, the eccentricity of said piston rod and said piston being approximately 0.5 to 5.0 percent of the outer diameter of said piston rod.

9. The unit of claim 8, wherein the eccentricity of said piston rod and said piston is designed such that restoring forces of said seal and of said guiding element of said piston are sufficient to prevent rotational movement of said piston with respect to said piston rod during operation of said unit.

10. The unit of claim 1, wherein the eccentricity of said piston rod and said piston is designed such that restoring forces of said seal and of said guiding element of said piston are sufficient to prevent rotational movement of said piston with respect to said piston rod during operation of said unit.

11. The unit of claim 1, wherein said inner thread of said piston has a diameter and said outer thread of said piston rod has a diameter, the diameters being designed to be as great as possible to transmit a great axial force.

12. The unit of claim 1, wherein said inner thread of said piston and said outer thread of said piston rod have a thread pitch of approximately between 2 mm and 5 mm.

13. The unit of claim 1, wherein said piston rod is designed and arranged to protrude out of said piston in a rear direction in the angle position in which the first axis of said piston rod is aligned to the first axis of said piston, and wherein said piston rod is designed and arranged to directly contact said housing in a pressureless condition.

14. The unit of claim 1, wherein said piston rod and said piston include marks being designed and arranged to indicate and determine the angle position in which the first axis of said piston rod is aligned to the first axis of said piston.

15. A piston assembly, comprising:

a piston rod having an outer surface being designed to be symmetrical with respect to a first axis, said piston rod including an outer thread being designed to be symmetrical with respect to a second axis, said second axis being spaced apart from said first axis to define a first eccentricity of said piston rod; and a piston being having an outer surface designed to be symmetrical with respect to a first axis, said piston configured to be subjected to pressure of a fluid in a pressure chamber said piston including an opening and an inner thread being located in said opening, said opening and said inner thread being designed to be symmetrical with respect to a second axis, said second axis being spaced apart from said first axis to define a second eccentricity of said piston, the first eccentricity of said piston rod being substantially identical to the second eccentricity of said piston such that said inner thread of said piston can engage said outer thread of said piston rod to reach an angle position in which the first axis of said piston rod is aligned to the first axis of said piston.

* * * * *